US010617180B1

(12) United States Patent
Yen

(10) Patent No.: US 10,617,180 B1
(45) Date of Patent: Apr. 14, 2020

(54) METAL BODY BUCKLE

(71) Applicant: Ying-Chuan Yen, Changhua County (TW)

(72) Inventor: Ying-Chuan Yen, Changhua County (TW)

( * ) Notice: Subject to any disclaimer, the term of this patent is extended or adjusted under 35 U.S.C. 154(b) by 0 days.

(21) Appl. No.: 16/260,900

(22) Filed: Jan. 29, 2019

(30) Foreign Application Priority Data

Oct. 25, 2018 (CN) ..... 2018 1 1246453
Oct. 25, 2018 (CN) ..... 2018 2 1742060 U

(51) Int. Cl.
*A44B 11/25* (2006.01)
*A44B 11/26* (2006.01)

(52) U.S. Cl.
CPC ..... *A44B 11/266* (2013.01); *A44B 11/2592* (2013.01)

(58) Field of Classification Search
CPC ..... A44B 11/2592; A44B 11/266
See application file for complete search history.

(56) References Cited

U.S. PATENT DOCUMENTS 2,153,077 A * 4/1939 Clarke ..... A44B 11/2519 24/645
5,355,562 A * 10/1994 Matoba ..... A44B 11/266 24/625
5,465,472 A * 11/1995 Matoba ..... A44B 11/266 24/625
5,791,026 A * 8/1998 Anscher ..... A44B 11/266 24/615
6,052,875 A * 4/2000 Fudaki ..... A44B 11/266 24/615
6,163,942 A * 12/2000 Liao ..... A44B 11/266 24/591.1
6,292,985 B1 * 9/2001 Grunberger ..... A44B 11/2592 24/303
6,553,637 B1 * 4/2003 Chen ..... A44B 11/266 24/614
6,560,830 B1 * 5/2003 Chi ..... A44B 11/266 24/616
7,219,406 B2 * 5/2007 Chui ..... A44B 11/266 24/593.1
7,373,701 B2 * 5/2008 Coulombe ..... A44B 11/253 24/171
8,281,464 B2 * 10/2012 Shen ..... A44B 11/266 24/614

(Continued)

*Primary Examiner* — Jason W San
(74) *Attorney, Agent, or Firm* — Jackson IPG PLLC; Demian K. Jackson

(57) ABSTRACT

The present invention discloses an integrated buckle of metal and plastics, comprising a female buckle and a male buckle. The male buckle comprises a male buckle body and left and right pins connected to the male buckle body. The male buckle body is made of metal, the left and right pins are connected to the male buckle body by rotating shafts to form a side-to-side rotational structure. A plastic flick piece is located between two pins, the plastic flick piece is fixed to the male buckle body. An elastic arm is located on both sides of plastic flick piece respectively, the two elastic arms hold two pins respectively. The present invention uses metal material to make male buckle body and pins, and the elasticity of pins is derived from the elastic arms on both sides of plastic flick piece.

7 Claims, 2 Drawing Sheets

(56) References Cited

U.S. PATENT DOCUMENTS 8,484,814 B2 * 7/2013 Parisi ..... A44B 11/263 24/614
8,572,820 B2 * 11/2013 Richards ..... A44B 11/2519 24/634
9,032,767 B2 * 5/2015 Takahashi ..... A44B 11/2546 24/614
9,365,164 B2 * 6/2016 Ackeret ..... B60R 7/043
9,521,882 B2 * 12/2016 Hung ..... A44B 11/2511
10,219,587 B1 * 3/2019 Chan ..... A44B 11/005
2002/0040514 A1 * 4/2002 Uehara ..... A44B 11/266 24/614
2002/0040515 A1 * 4/2002 Uehara ..... A44B 11/266 24/614
2005/0207837 A1 * 9/2005 Kosh ..... A44B 11/2592 403/327
2008/0086853 A1 * 4/2008 Kolasa ..... A44B 11/266 24/625
2008/0134479 A1 * 6/2008 Kolasa ..... A44B 11/266 24/625
2008/0178438 A1 * 7/2008 Yoshie ..... A44B 11/266 24/616
2009/0013510 A1 * 1/2009 Liang ..... A44B 11/266 24/648
2009/0100652 A1 * 4/2009 Mok ..... A44B 11/266 24/625
2010/0306976 A1 * 12/2010 Kaneko ..... A44B 11/266 24/700
2013/0232743 A1 * 9/2013 Takazakura ..... A44B 11/266 24/625
2015/0135494 A1 * 5/2015 Kataguchi ..... A44B 11/266 24/697.1
2015/0351500 A1 * 12/2015 Kolasa ..... A44B 11/266 24/615
2017/0000220 A1 * 1/2017 Moran ..... A44B 11/26
2018/0289113 A1 * 10/2018 Chu ..... A44B 11/266

* cited by examiner

METAL BODY BUCKLE

BACKGROUND OF INVENTION

1. Field of the Invention

The present invention relates generally to the technical field of buckle accessories, and more particularly to a buckle for fixing belts.

2. Description of Related Art

Buckles are extensively used in dress, bags, sports equipments and so on, for fixing ornamental belts, face fabrics and so on to some extent. A buckle generally comprises a male buckle and a female buckle, the male buckle is inserted in the female buckle for fixing. At present, the commercially available all-metal buckles implement chucking and rebounding functions mainly in two ways. One is to use metal springs to provide the elasticity of inserter (pin). The other one is to use elastic mechanisms, e.g. metal spring leaves, to provide the elasticity of male buckle. However, said two forms of buckle have some inherent defects, such as complex spring or spring leaf structure, high assembly cost, and the metal is likely to rust, leading to inconvenience in using products.

In addition, the structures of spring and spring leaf are complex, when the products are reduced to a small size, the production is difficult, they cannot be used to make small size male buckles, failures are likely to occur, the elasticity is lost.

Therefore, the present invention creates an integrated structure of metal and plastics, which has the surface texture of metal, as well as the hardness of metal. The tension and elasticity for the flick structure are provided by the plastic part, thereby reducing the product weight, and forming a buckling structure with a simple structure and higher applicability.

SUMMARY OF THE INVENTION

The technical problems to be solved by the present invention are the defects in the existing technology, so as to provide a smaller integrated buckle of metal and plastics with simple structure, reasonable design, good elasticity and longer life.

In order to solve said technical problems, the present invention uses the following technical proposal: a metal body buckle, comprising a female buckle and a male buckle. The male buckle comprises a male buckle body and left and right pins connected to the male buckle body. The female buckle has a plug hole, the two pins of male buckle are inserted in the plug hole of female buckle to fasten the female buckle to form a fixed structure. There are cambered press lugs on the outer side of pins, when the pins are inserted in the plug hole, the tenon of male buckle seizes the locating slot in female buckle. Features: said male buckle body is made of metal, the left and right pins are connected to the male buckle body by rotating shafts to form a side-to-side rotational structure. There is a plastic flick piece between the two pins, the flick piece is fixed to the male buckle body, there is an elastic arm on both sides of plastic flick piece. The two elastic arms hold two pins respectively, forming an elastic structure pushing the pins outwards. The flick piece and the elastic arms on both sides of it are made of plastic material.

Furthermore, a forward extended fixed arm is located in the middle position of front end of male buckle body, a fixed slot is located in said flick piece, a snap is located on the top surface of fixed slot, there is a catching groove on the surface of fixed arm, when the fixed arm is inserted in the fixed slot of plastic flick piece, it is detained by snap in the catching groove to form a fixed structure of flick piece and fixed arm.

Furthermore, there is a groove in the inner side of two pins respectively. The elastic arms on both sides of said flick piece are stuck in the two grooves and combined with the pins to form a flick structure, so that the elastic arms are combined with the pins nicely to avoid dropout.

Furthermore, there is an axle bed near the two edges of front end of male buckle body respectively, the two pins are fixed to the axle beds by the rivets made of metal to form a rotatable structure, the metal material can work in normal condition for long.

Furthermore, the flick piece is provided with a guide slot opened in the male buckle inserting direction. The plug hole of female buckle is provided with a guide bar matching the guide slot. When the male buckle is being inserted in the female buckle, the guide bar is inserted in the guide slot to form the guide structure of male buckle insertion process, the insertion of male buckle is smoother, so as to avoid misinsertion damaging the female buckle and pins.

Preferably, said pins are made of metal, and the pins are arched. The plastic elastic arms are also arched (or other shapes), the arch has better elasticity and stronger compression resistance, so the service life is longer, and the product weight is reduced.

Preferably, the male buckle body and pins are made of zinc alloy or aluminum alloy, low cost, easy forming; the plastic flick piece is made of nylon or POM material, good elasticity, long service life.

When the male buckle is being inserted in the female buckle, the plug hole of female buckle extrudes the two pins, the pins extrude the elastic arms inward. When the pins are completely inserted, the pins rebound under the elastic effect of plastic elastic arms, so that the pins move outwards to seize both sides of female buckle to implement fixing.

The present invention uses metal material (e.g. zinc alloy or aluminum alloy) to make male buckle body and pins. The elasticity of pins is derived from the elastic arms on both sides of plastic flick piece. The plastic flick piece is free from the rusting risk of metal springs or spring leaves, while reducing the product weight and ensuring the lightweight. Its structure is simple, even if the size is small, the pins have good elasticity, applicable to producing ⅜" or smaller 8 mm male buckles. Therefore, the whole buckle can be smaller, the applicability of buckle is increased, and the good elasticity is guaranteed, the service life is longer.

As shown in the figures, 1 is the male buckle, 11 is the male buckle body, 12 is the pin, 121 is the press lug, 122 is the groove, 123 is the male buckle convex insert, 13 is the pin, 14 is the axle bed, 15 is the rivet, 16 is the fixed arm, 17 is the flick piece, 171 is the elastic arm, 172 is the guide slot, 173 is the snap, 2 is the female buckle, 21 is the plug hole, and 22 is the female buckle locating slot.

DETAILED DESCRIPTION OF THE INVENTION

Figure 1:
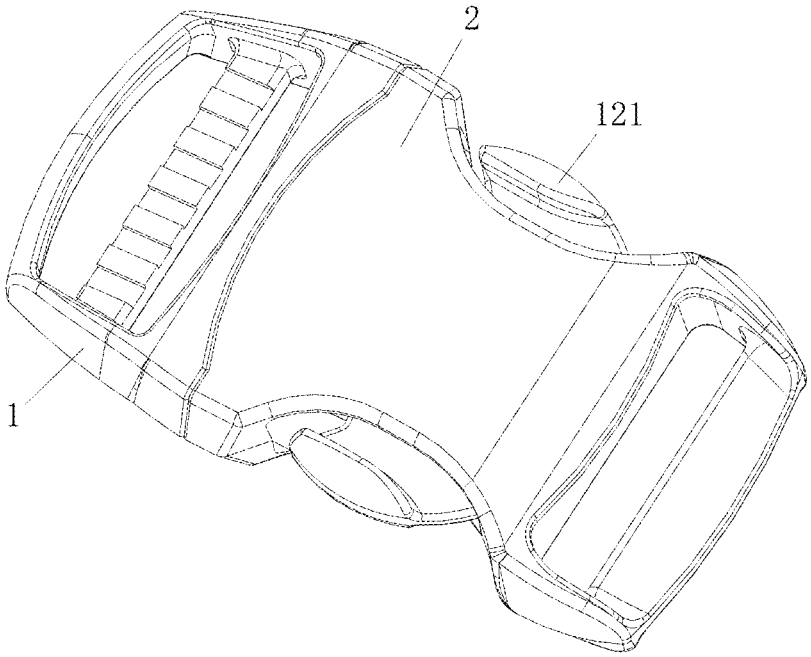
FIG. 1 is the three-dimensional structure diagram of the present invention.
Figure 2:
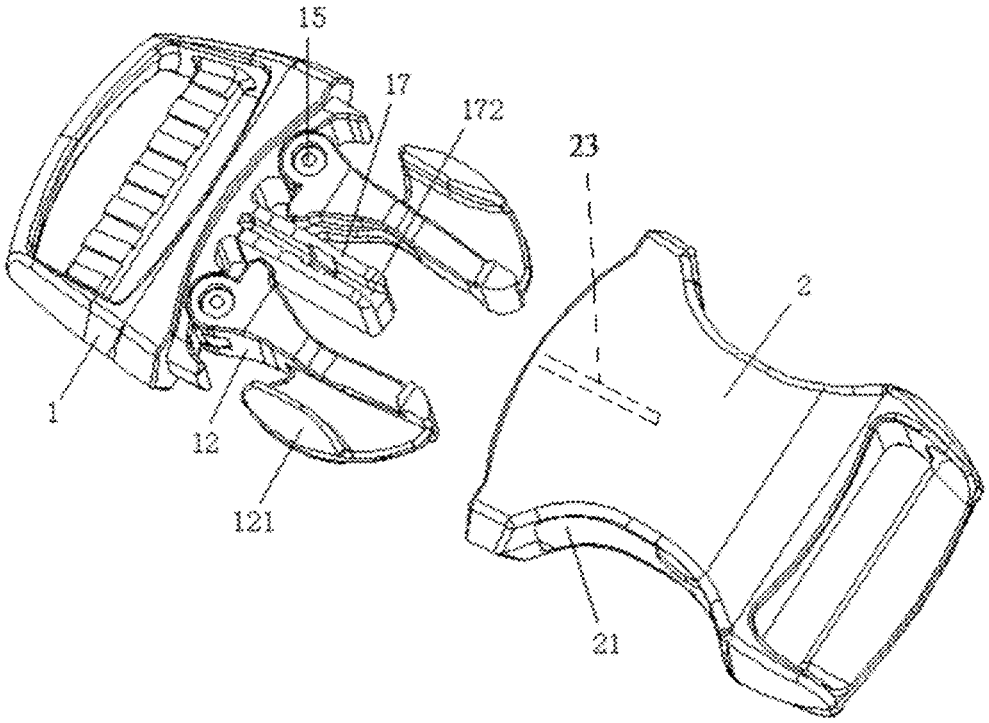
FIG. 2 is the exploded structural diagram of the present invention.
Figure 3:
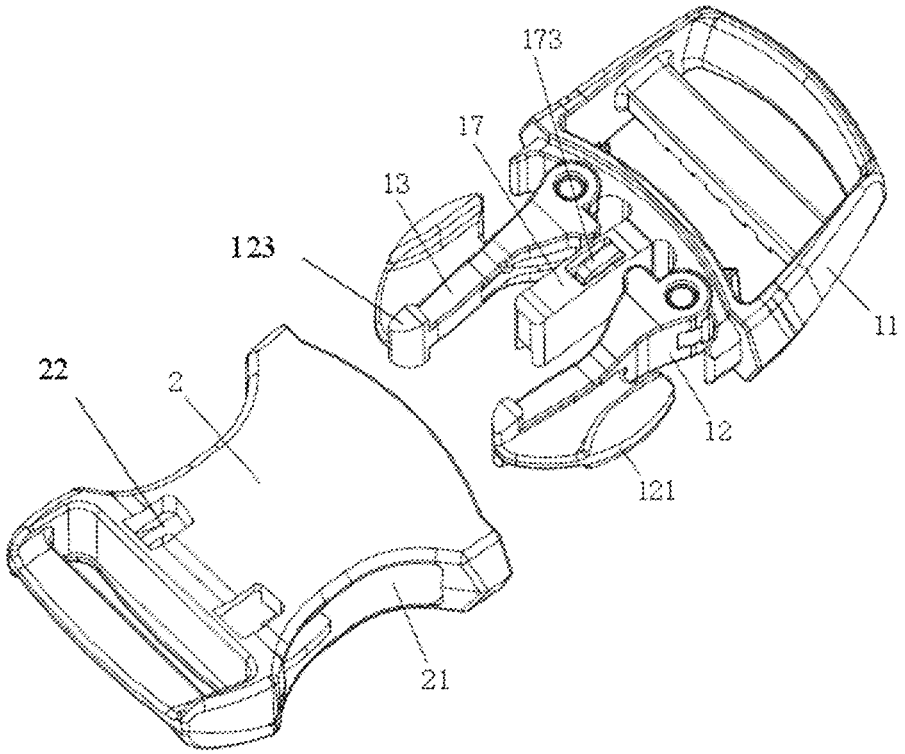
FIG. 3 is the exploded structural diagram from another angle of the present invention.
Figure 4:
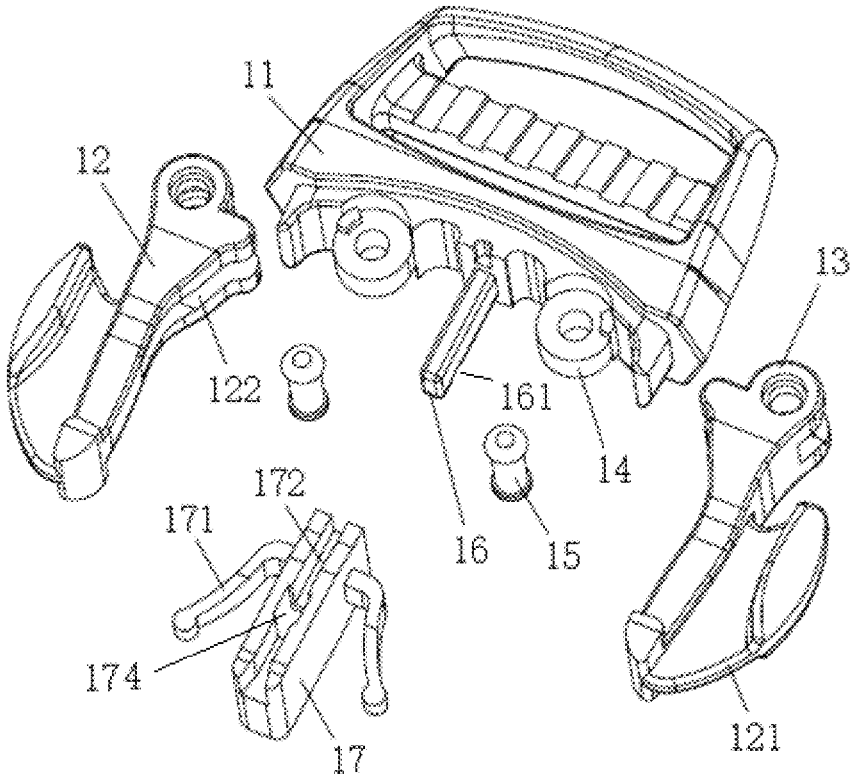
FIG. 4 is the exploded structural diagram of male buckle.

In this embodiment, as shown in FIGS. 1 to 4, said integrated buckle of metal and plastics comprises a female buckle 2 and a male buckle 1. The male buckle 1 comprises a male buckle body 11 and left and right pins 12, 13 connected to the male buckle body 11. The female buckle 2 has a plug hole 21, the two pins 12, 13 of male buckle 1 are inserted in the plug hole 21 of female buckle 2 to fasten the female buckle 2 to form a fixed structure. There are cambered press lugs 121 on the outer side of pins 12, 13, when the pins 12, 13 are inserted in the plug hole 21, the male buckle convex insert 123 is affixed to the female buckle locating slot 22. Said male buckle body 1 is made of metal, the left and right pins 12, 13 are connected to the male buckle body 11 by rotating shafts to form a side-to-side rotational structure. There is a flick piece 17 between two pins 12, 13, the flick piece 17 is fixed to the male buckle body 11. There is an elastic arm 171 on both sides of plastic flick piece 17, the two elastic arms 171 hold two pins 12, 13 respectively to form an elastic structure pushing the pins 12, 13 outwards. The flick piece 17 and the elastic arms on both sides of it are made of plastic material.

A forward extended fixed arm 16 is located in the middle position of front end of male buckle body 11, a fixed slot 174 is located in said flick piece 17, a snap 173 is located on the top surface of fixed slot 174, there is a catching groove 161 on the surface of fixed arm 16, when the fixed arm 16 is inserted in the fixed slot 174 of flick piece 17, it is detained by snap 173 in the catching groove 161 to form a fixed structure of flick piece 17 and fixed arm 16.

There is a groove 122 in the inner side of two pins 12, 13 respectively. The elastic arms 171 on both sides of said flick piece 17 are stuck in the two grooves 122 and combined with the pins 12, 13 to form a flick structure, so that the elastic arms 171 are combined with the pins 12, 13 nicely to avoid dropout.

There is an axle bed 14 near the two edges of front end of male buckle body 11 respectively, the two pins 12, 13 are fixed to the axle beds 14 by the rivets 15 made of metal to form a rotatable structure, the metal material can work in normal condition for long.

The flick piece 17 is provided with a guide slot 172 opened in the male buckle inserting direction. The plug hole 21 of female buckle 2 is provided with a guide bar 23 matching the guide slot 172. When the male buckle 1 is being inserted in the female buckle 2, the guide bar 23 is inserted in the guide slot 172 to form the guide structure of male buckle 1 insertion process, the insertion of male buckle 1 is smoother, so as to avoid misinsertion damaging the female buckle 2 and pins 12, 13.

Said pins 12, 13 are made of metal, and the pins 12, 13 are arched. The elastic arms 171 are also arched (or other shapes), the arch has better elasticity and stronger compression resistance, so the service life is longer.

The male buckle body 11 and pins 12, 13 are made of zinc alloy or aluminum alloy, low cost, easy forming; the flick piece 17 is made of nylon or POM material, which endows the features of good elasticity, long service life, and light product weight.

When the male buckle 1 is being inserted in the female buckle 2, the plug hole 21 of female buckle 2 extrudes the two pins 12, 13, the pins 12, 13 extrude the elastic arms 171 inwards. When the pins 12, 13 are completely inserted, the pins 12, 13 rebound under the elastic effect of elastic arms 171, so that the pins 12, 13 move outwards, so that the male buckle convex insert 123 is affixed to the female buckle locating slot 22.

The present invention has been described in detail, what stated above is merely the preferred embodiment of the present invention, not to limit the scope of implementation of the present invention, any equivalent changes and modifications made according to the range of this application shall be in the coverage of the present invention.

The invention claimed is:

1. An integrated buckle of metal and plastics comprising a female buckle and a male buckle; the male buckle comprises a male buckle body and left and right pins connected to the male buckle body; the female buckle has a plug hole, the two pins of the male buckle are inserted in the plug hole of the female buckle to fasten the female buckle to form a fixed structure; there are cambered press lugs on the outer side of the pins, when the pins are inserted in the plug hole, a male buckle convex insert is affixed to a female buckle locating slot; wherein said male buckle body is made of metal, the left and right pins are connected to the male buckle body by rotating shafts to form a side-to-side rotational structure; there is a plastic flick piece between the two pins, the flick piece is fixed to the male buckle body, there is an elastic arm on opposed sides of the plastic flick piece; the two elastic arms hold the two pins respectively, forming an elastic structure pushing the pins outwards; and the flick piece and the elastic arms on opposed sides of it are made of plastic material.

2. The metal body buckle defined in claim 1, further comprising a forward extended fixed arm located in the middle position of a front end of the male buckle body, a fixed slot located in said plastic flick piece, a snap located on the top surface of fixed slot, a catching groove located in the surface of fixed arm and wherein, when the fixed arm is inserted in the fixed slot of flick piece, it is detained in the catching groove by the snap to form a fixed structure of flick piece and fixed arm.

3. The metal body buckle defined in claim 1, features: there is a groove in the inner side of two pins respectively, the elastic arms on both sides of said flick piece are stuck in the two grooves respectively and combined with the pins to form an integrated flick structure of metal and plastics.

4. The metal body buckle defined in claim 1, features: there is an axle bed near the two edges of front end of male buckle body respectively, the two pins are fixed to the axle beds by metal rivets to form a rotatable structure.

5. The metal body buckle defined in claim 1, features: the flick piece is provided with a guide slot opened in the male buckle inserting direction, the plug hole of female buckle is provided with a guide bar matching the guide slot; when the male buckle is being inserted in the female buckle, the guide bar is inserted in the guide slot to form the guide structure of male buckle insertion process.

6. The metal body buckle defined in claim 1, features: said pins are made of metal, and the pins are arched, the elastic arms are arched, too.

7. The metal body buckle defined in claim 1, features: the male buckle body and pins are made of zinc alloy or aluminum alloy, and the plastic flick piece is made of nylon or POM material.

* * * * *